US005386649A

United States Patent [19]

Paris

[11] Patent Number: 5,386,649

[45] Date of Patent: Feb. 7, 1995

[54] SKI BOOT WITH LINER HAVING FRONT AND REAR STRADDLING PORTIONS

[75] Inventor: Jean Paris, Sevrier, France

[73] Assignee: Salomon S.A., Metz-Tessy, France

[21] Appl. No.: 92,986

[22] Filed: Jul. 19, 1993

[30] Foreign Application Priority Data

Aug. 14, 1992 [FR] France ..... 92 10111

[51] Int. Cl.[6] ..... A43B 5/04

[52] U.S. Cl. ..... 36/117; 36/55; 36/10

[58] Field of Search ..... 36/117–121, 36/71, 55, 10, 50.5, 50.1; 12/142 P

[56] References Cited

U.S. PATENT DOCUMENTS

| | | | |
|---|---|---|---|
| 2,343,477 | 3/1944 | Ross | 36/10 |
| 3,786,580 | 1/1974 | Dalebout | 36/117 |
| 4,301,564 | 11/1981 | Dalebout | 36/117 |
| 4,499,675 | 2/1985 | Perotto | 36/10 |
| 4,839,973 | 6/1989 | Dodge | 36/119 |
| 5,167,083 | 12/1992 | Walkoff | 36/117 |
| 5,174,050 | 12/1992 | Gabrielli | 36/54 |

FOREIGN PATENT DOCUMENTS

| | | | |
|---|---|---|---|
| 607268 | 3/1934 | Germany | 36/10 |
| 125933 | 8/1949 | Sweden | 36/10 |

*Primary Examiner*—Paul T. Sewell
*Assistant Examiner*—Thomas P. Hilliard
*Attorney, Agent, or Firm*—Sandler, Greenblum & Bernstein

[57] ABSTRACT

A ski boot having a liner, the liner including a body overlaid by a rear wedge associated to a portion of upper of boot and a front wedge associated to another portion of the upper. The front and rear wedges of the liner cooperate with respect to each other to ensure the closure of the introduction opening of the foot of the skier and define between them, at least two mutually straddling lateral zones which respectively extend along a predetermined length, and whose positioning is guaranteed along an irreversible direction by at least one extensible connection element, acting elastically between the wedges in the manner of a deflector, along converging forces tending to bring them closer to one another, permanently, towards an initial closure position of liner.

16 Claims, 5 Drawing Sheets

Fig- 1
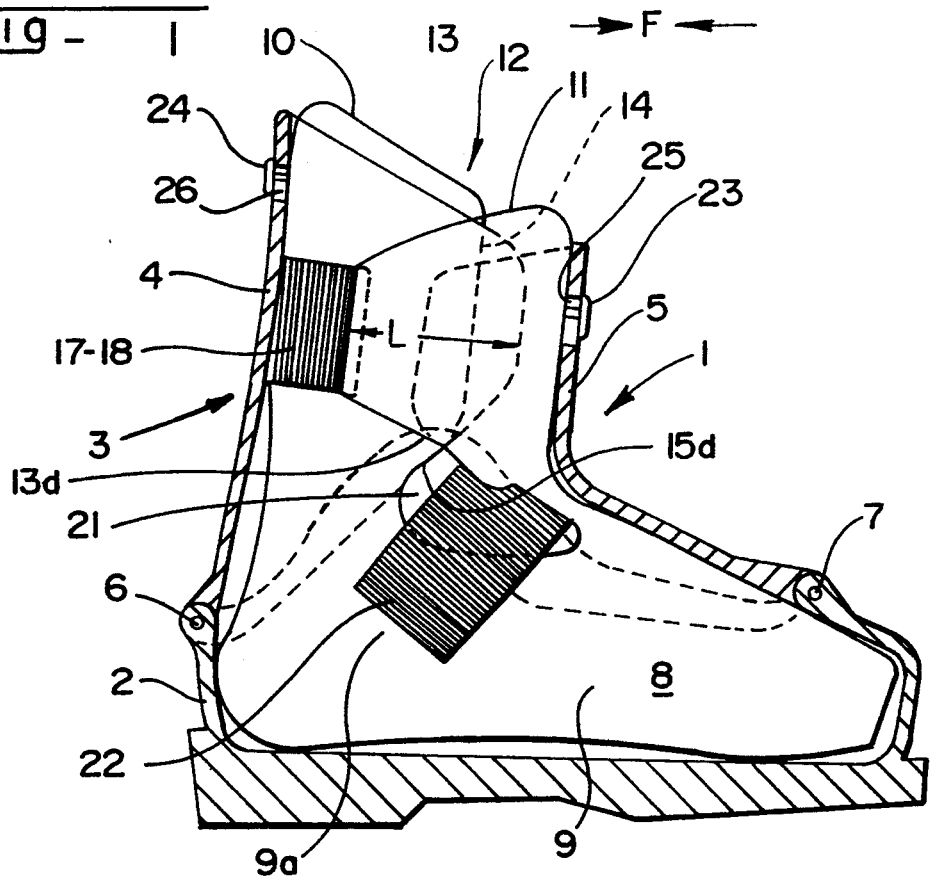
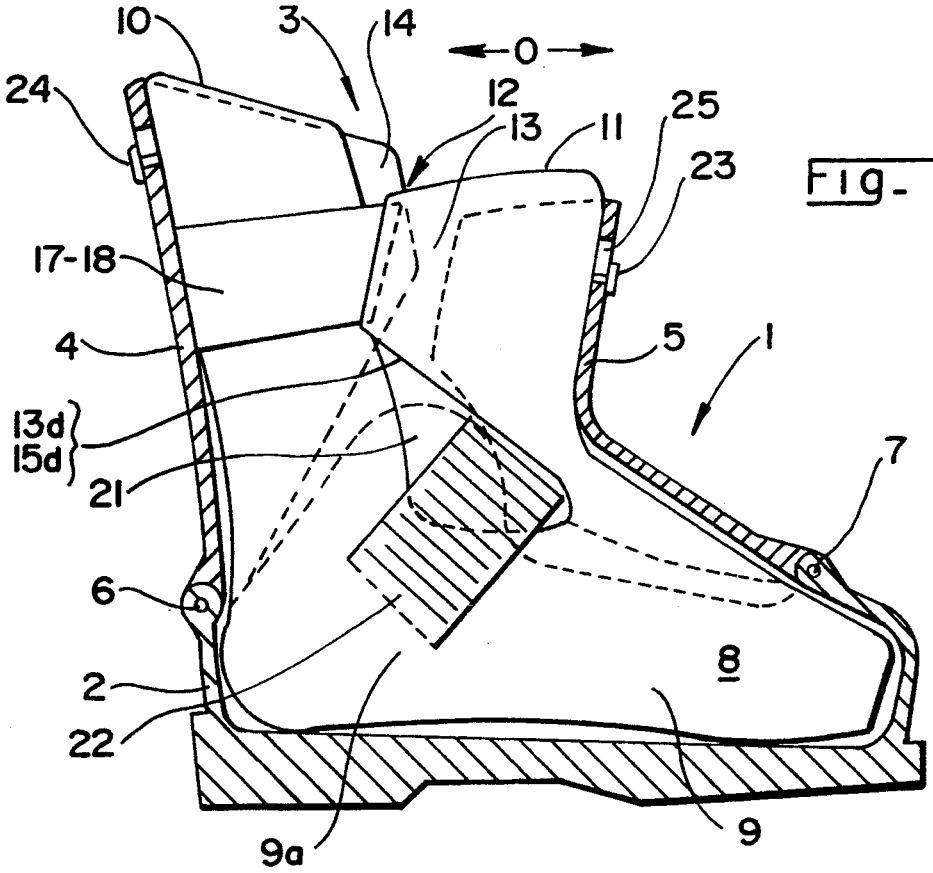
Fig- 2

SKI BOOT WITH LINER HAVING FRONT AND REAR STRADDLING PORTIONS

BACKGROUND OF THE INVENTION

1. Field of the Invention

The present invention is related to an alpine ski boot constituted by a shell whose shell base is overlaid by an upper having a rear portion and a front portion, at least one of such portions being journalled with respect to the other and with respect to the shell base by means of a transverse axis. The shell is padded internally by a removable flexible liner inserted between the foot and the lower part of the leg of the skier and the shell. The liner includes a body enveloping the foot and is overlaid, on the one hand, by a rear wedge associated to the rear portion of the upper of the boot, and, on the other hand, by a front wedge associated to the front portion. The front and rear wedges cooperate with each other to ensure closure of an introduction opening of the liner by a tightening action of at least one part of the upper on the other.

2. Discussion of Background and Relevant Information

A liner of the aforementioned type is described in European Patent Application No. 427 321. This liner is adapted to a front entry boot and comprises a front wedge constituted by a removable tongue adapted to block an introduction opening of the foot, demarcated by lateral wings of a rear wedge integral with a portion of the foot of the liner.

In order to limit the clearance of the tongue and to ensure its positioning on the front upper portion of the foot, in its connection zone with the foot of the liner, an elastic band brushes this lower end zone of the tongue. The elastic band is connected by its ends on the lower portions of the lateral wings deriving from the rear wedge.

However, such a liner does not enable a major disadvantage to be avoided, which lies in the fact that during a maximum spacing of the tongue with respect to the rear wedge of the liner, while removing or putting on the boot, generally fortuitous abutting of the lateral edges of the tongue occurs with the lateral edges of the wings of the rear wedge, thus causing a blockage during opening of such portions and, consequently, an intervention by the user.

According to another type of incident encountered after a maximum opening of the liner, one of the edges of the tongue, or even both, do not readopt their initial positioning, within the wings of the rear wedge, for example, and cause overthicknesses which can be detrimental to the comfort of the foot and also necessitate an intervention when this occurs.

To overcome this, U.S. Pat. No. 3,599,351 describes a boot whose internal liner comprises a rear wedge having lateral wings largely covering during closure the edges of the tongue which are associated to it.

However, no means is provided in this boot to force the tongue to readopt its initial position after maximum opening during putting on and removal of the boot.

Swiss Patent No. 679 362 also shows lateral covering means of two journalled portions of a boot, but not only are the above-cited disadvantages not avoided, but at issue here are shell portions and not a liner.

SUMMARY OF THE INVENTION

It is an object of the present invention to overcome the various disadvantages by providing a removable and mono-block or one-piece liner in which its front and rear portions or wedges, journalled with respect to each other, can never get stuck, and neither can any change occur in the direction of their initial positioning.

Indeed, the invention is related to a boot of the above-cited type wherein the front and rear wedges of the mono-block liner define between them, on at least one portion of the introduction opening of the foot of the skier, at least two mutually straddling lateral zones whose initial positioning is guaranteed along an irreversible direction by means of at least one extensible connection element, acting elastically between the wedges, along converging forces tending to bring them closer with respect to one another, permanently, towards an initial closure position of the liner, the maximum extension capacity of the elastic connecting element being such so as not to allow a change in the chosen direction of positioning of the straddling zones of the wings.

According to a preferred embodiment of the invention, the straddling of the lateral zones is obtained by means of an extensible connection element which plays the role of a deflector with respect to the zones by forcing them to overlap towards one another, still in the same direction. To this end, the elastic connection element extends at least partially along the lateral zones of the front and rear wedges in a direction extending from the internal wall of one of the wedges to the external wall of the other wedge. In this way, even when the lateral zones of the liner are completely disengaged from one another and, therefore, theoretically capable of either coming back into abutment on their edge, or of getting straddled inversely to their initial position, the elastic connection element deviates, under the effect of the elastic resistance which it encounters between its point of support on the external wall of one of the wedges and its point of support on the internal wall of the other wedge, the end of the lateral zone of the wedge on which its point of support is located externally.

According to a variation of this embodiment of the invention, the elastic connection element is associated to a portion of the shell of the boot and cooperates with at least one of the front and/or rear wedges of the liner, and at the same time respects the preceding covering circuit enabling the connection element to play its role of deflector, forcing the return to the initial position of the lateral zones of the wedges.

According to another embodiment in accordance with the invention, the lateral straddling zones of the front and rear wedges of the liner extend respectively along a length at least equal to the separation value of the wedges, when they pass from a closure position on the lower part of the leg, to an opening position while putting on of the boot so as to ensure a relative fitting positioning of the straddling zones of the front and rear wedges whose initial positioning is guaranteed.

Such a characteristic as per the invention is applicable to all types of boots, whether they be the front, rear, central or mixed entry type.

BRIEF DESCRIPTION OF THE DRAWINGS

The invention will be better understood and other characteristics thereof will become clearer upon reading the description that follows, with reference to the annexed schematic drawings, illustrating in a non-limiting example, how the invention can be obtained and wherein:

FIGS. 1 and 2 are longitudinal sectional views of the shell of a central and/or mixed entry boot equipped with a liner as per the invention respectively closed and open, not represented in a section.

DETAILED DESCRIPTION OF THE PREFERRED EMBODIMENTS

Figure 3:
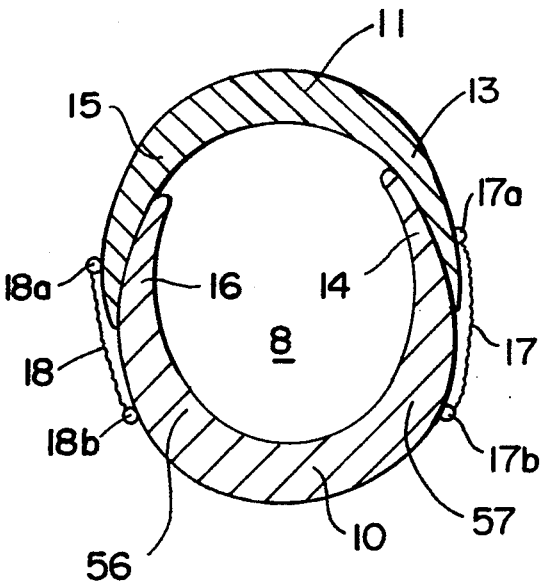
FIGS. 3 to 5 are transverse sections representing different types of liners as per the invention.

Boot 1, generally designated in FIGS. 1 and 2, is a central and/or mixed entry boot.

In addition, it is comprised in a known manner by a rigid shell whose shell base 2 is overlaid by an upper 3 constituted by a rear portion or rear spoiler 4 and a front portion or front cuff 5. As shown in the drawings, rear spoiler 4 is journalled at its lower portion on a rear zone of shell base 2 by means of a pin or axle along transverse axis 6, whereas front cuff 5 is journalled at its lower portion on a front upper zone of shell base 2 by means of a pin or axle along transverse axis 7.

The shell of boot 1 is padded internally by a unitary and removable flexible liner 8 inserted between the foot and the lower part of the leg of the skier and the rigid shell.

Liner 8 comprises a body 9 enveloping the foot and is overlaid, on the one hand, by a rear wedge 10 associated to rear spoiler 4 of upper 3 of the boot, and on the other hand, by a front wedge 11 associated to front cuff 5, the front 11 and rear 10 wedges cooperating with each other to ensure the closure of an introduction opening 12 of the foot of the skier in the liner 8, by a tightening action of rear spoiler 4 towards front cuff 5.

As per the invention, the front 11 and rear 10 wedges of liner 8 define between them two mutually straddling lateral zones 13 and 14 for one of the lateral sides of liner 8, and 15 and 16 for the other side, which extend respectively along a length "L" at least equal, but preferably greater, than the maximum distancing value of the wedges 10, 11 when they switch from a closure position "F" on the lower part of the leg (FIG. 1) to an opening position "0" (FIG. 2), during insertion and removal of the boot.

This ensures a relative positioning of the straddling zones 13, 14 and 15, 16 of front and rear wedges 10, 11 along an irreversible direction, and is guaranteed by means of two connection elements 17, 18 which are extensible and located laterally on either side of liner 8 and act elastically between the wedges 10, 11 along converging forces.

These forces tend to bring wedges 10, 11 closer to one another, permanently, towards an initial closure position of liner 8, the maximum extension capacity of the elastic connection elements 17, 18 being such so as to not allow a change in the chosen direction of positioning of the straddling zones 13, 14, 15, 16 of wedges 10, 11.

According to the present embodiment (FIG. 3), the front wedge 11 of liner 8 comprises straddling zones 13 and 15 provided laterally on either side of liner 8 and covering the corresponding zones 14 and 16 of rear wedge 10 externally.

As per this example and as mentioned previously, the connection of front 11 and rear 10 wedges of liner 8 is done by means of two elastic elements 17, 18 whose ends **17*a*, 17*b* and 18*a*, 18*b* are respectively affixed on the one hand to the straddling zones 13 and 15 of front wedge 11 in external covering and, on the other hand, to rear portions 56, 57 of the corresponding straddling zones 14, 16 of rear wedge 10**, in internal covering.

Figure 4:
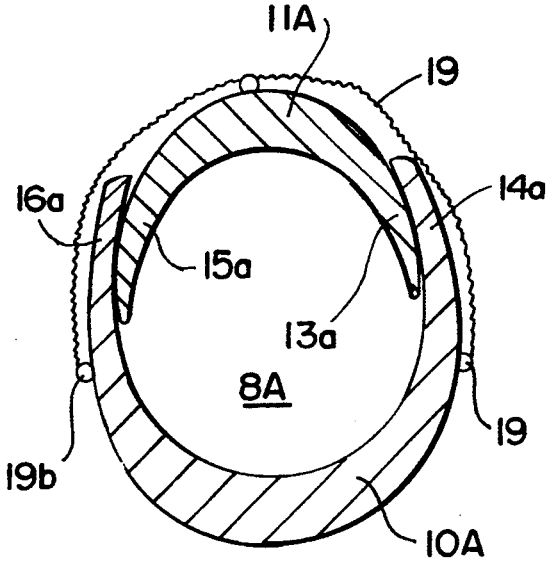

The embodiment represented in FIG. 4 mainly differs from the previous in that the straddling zones **13*a* and 15*a* of front wedge 11A of liner 8A get engaged within the corresponding zones 14*a*, 16*a* of rear wedge 10A, such elements 14*a*, 16*a*** therefore covering them externally.

According to the latter example, the connection of the front 11A and rear 10A wedges of liner 8A is done by means of a single elastic element 19, whose ends (**19*a*, 19*b*) are respectively affixed to the straddling zones 14*a*, 16*a* of rear wedge 10A, which externally cover and externally encircle front wedge 11A, whose corresponding zones 13*a* and 15*a* are in internal covering, i.e., they get nested beneath zones 14*a* and 16*a***.

Figure 5:
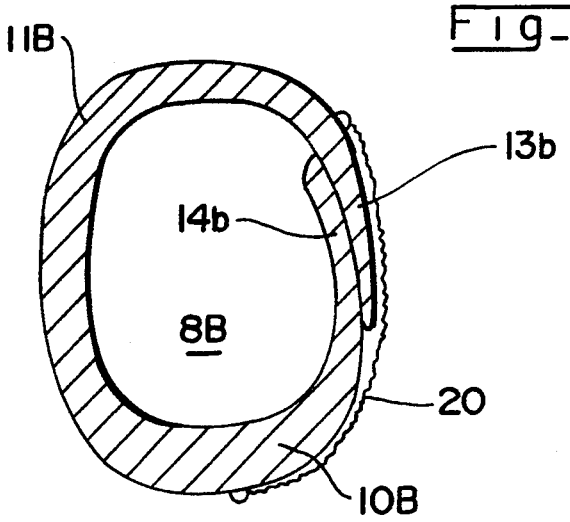

According to the embodiment represented in FIG. 5, this mainly differs from the previous examples in that the front wedge 11B of liner 8B only comprises a single lateral straddling zone **13*b* covering a corresponding zone 14*b* of rear wedge 10B, the front and rear wedges 10B, 11B being obtained in a single piece in each others extension so as to form a liner 8B** closed unilaterally.

In this case, the connection of front lib and rear 10B wedges is done unilaterally by means of an elastic element 20 inserted between the respective straddling zones **13*b*, 14*b* of the wedges 10B, 11B**.

As can also be seen in FIGS. 1 and 2, a cutout 21 favoring the relative flexion of front 11 and rear 10 wedges is obtained between their straddling zones 13, 14 and 15, 16 in a lower connection portion with body 9 of liner 8.

According to another characteristic, an elastic connection element 22 is inserted between at least one lower edge **13*d*, 15*d* of one of the straddling zones 13, 15 demarcated by cutout 21 (21A and 21B for liners 38, 38B, 8A and B of FIGS. 6, 7, 8, 9, 10 and 11) and a portion 9*a* of body 9 of liner 8**.

According to another characteristic of the invention, the elastic connection element 17, 18, 19, 20, 22 are constituted by straps obtained in a rubberized material.

Naturally, they can also be obtained by elastic bands which can be made of one or several elements.

Figure 6:
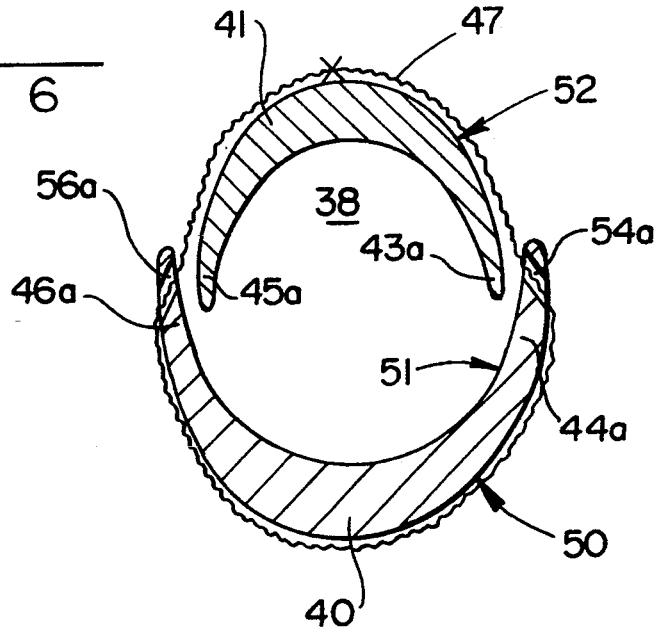
FIGS. 6 and 7 are transverse sections of the types of liners similar to those of FIGS. 3 to 5, but in which an inextensible connection element is arranged to act as a deflector on the straddling zones of the front and rear wedges of the liner, still as per the invention.
Figure 7:
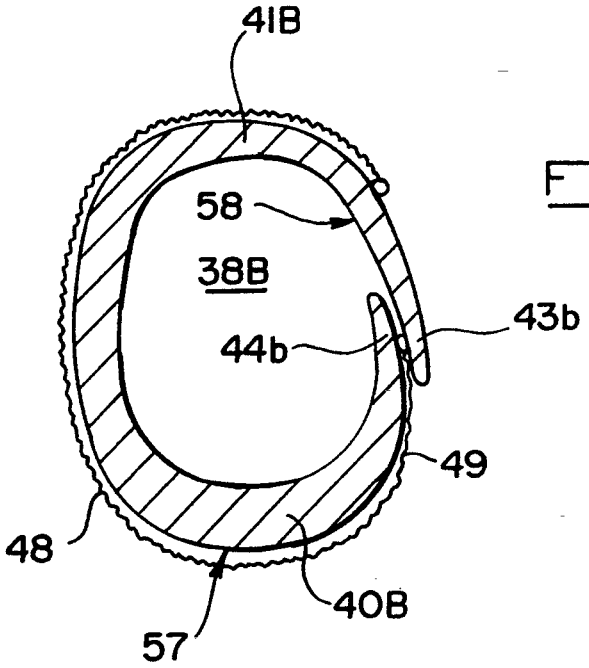

In the embodiments represented in FIGS. 6 and 7, the liner types 38 and 38B are similar to those of FIGS. 3 and 5, but the elastic connection elements are located so as to play the role of a deflector with respect to the respective straddling zones at each liner.

Thus in the case of FIG. 6, the elastic connection element 47 which is associated to liner 38 is present in the shape of a band which takes support on the external wall 50 of rear wedge 40, along which it extends to come up to the straddling zones **44*a* and 46*a* which cover zones 43a and 45a of front wedge 41: from the straddling zones 44a and 46a which are equipped with guide channels 54a and 56a, the elastic element 47 is initially passed through these which guide it, and act as points of support for it, towards inner wall 51 of the rear wedge 40, to be then brought while covering on the lower wall 52 of front wedge 41**.

In the example represented, connection element 47 is provided in a single piece but can also be obtained in two pieces, which, in such a case, would be located to each connect the corresponding straddling zone 43a–44a or 45a–46a while at the same time respecting the circuit described previously determining, for the connection element 47, a point of support and/or return located on the internal wall of one of the wedges of the liner and a point of support on the external wall of the other wedge which is therefore mainly adapted to become nested in the first.

This is also the case in the example of FIG. 7 where liner 38B only comprises a single lateral straddling zone 43b–44b. It is not useful to arrange guide channels such as described with reference to FIG. 6, because the connection element 48 does, in fact, take support on the extension of the external wall 57 extending from front wedge 40B to be connected thereafter on the internal wall 58 of rear wedge 41B.

It is clear from the description hereinabove with reference to FIGS. 6 and 7 that the lateral straddling zones can extend along reduced lengths, due to the fact that the elastic connection elements 47, 48 play the role of a deflector determined by the position of its points of support and/or connection, on one of the walls of a wedge of the liner with respect to the other wall of the other wedge of the liner.

According to another characteristic of the invention, the entry of boot 1 represented in FIGS. 1 and 2, being central and/or mixed, the rear wedge 10, 10A, 10B of liner 8, 8A, 8B is connected slidably to rear spoiler 4 of upper 3, which is itself journalled at axis 6, at its lower portion on a rear zone of shell base 2, the front wedge 11, 11A, 11B of liner 8, 8A, 8B being also connected slidably to front cuff 5 of upper 3, itself journalled at axis 7, in a front upper zone of shell base 2.

The sliding means are constituted by pins 23 and 24 affixed to front 11 and rear 10 wedges of liner 8 and are adapted to slide in corresponding longitudinal slots 25 and 26 obtained respectively in front cuff 5 and rear spoiler 4 of upper 2.

Figure 8:
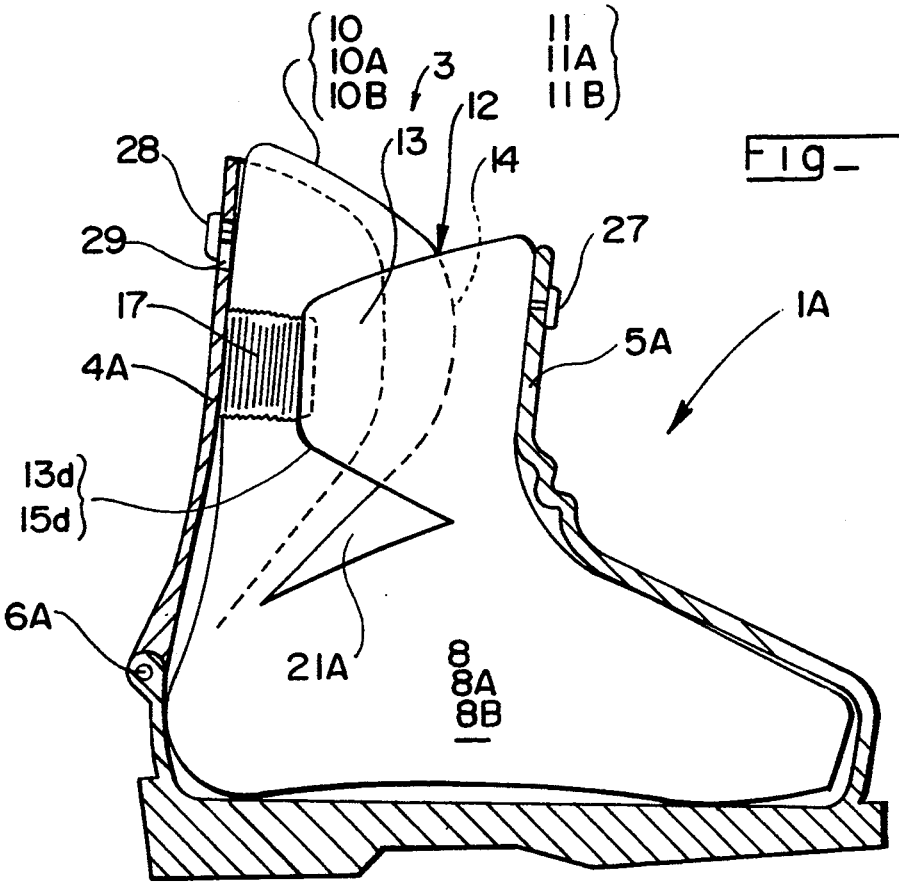
FIGS. 8 and 9 are longitudinal sectional views of a shell of a ski boot of the rear entry type equipped with a liner as per the invention not represented in a section, respectively closed and open.
Figure 9:
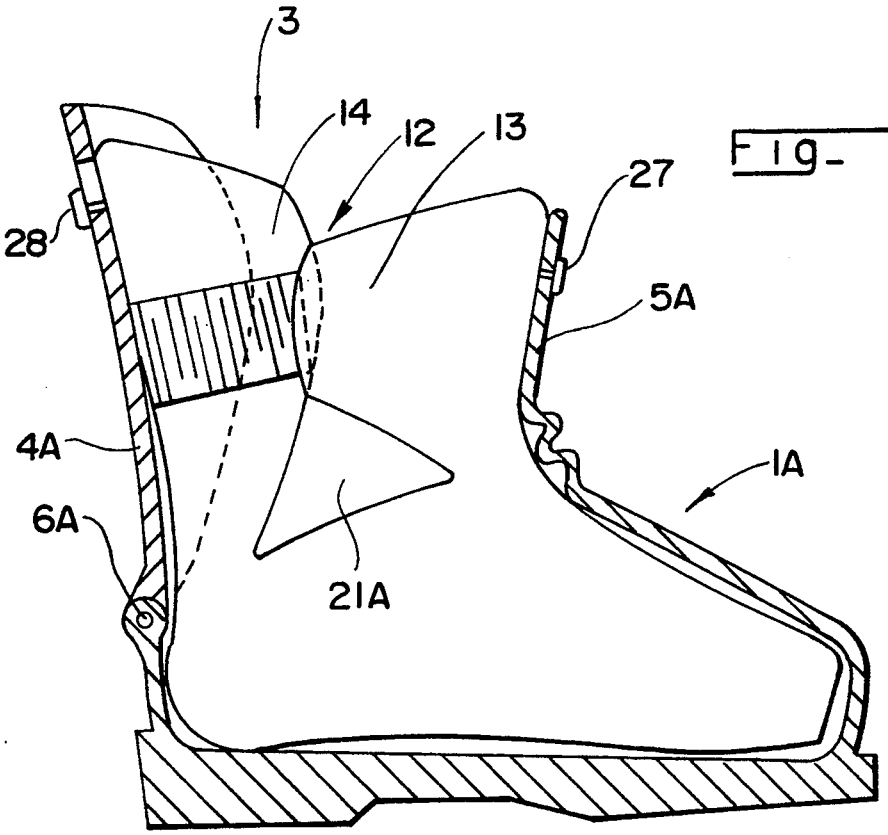

The embodiment of boot 1A represented in FIGS. 8 and 9 mainly differs from those of FIGS. 1 and 2 in that its entry occurs from the rear, whereby the front wedge 11, 11A, 11B of liner 8, 8A, 8B is connected fixably to fixed front cuff 5a of upper 3, whereas the rear wedge 10, 10A, 10B is slidably connected to the corresponding rear spoiler 4A of upper 3, itself journalled, 6A, at its lower portion on a rear zone of shell base 2.

In this case, a rivet 27 ensures the fixed connection of front cuff 5A with front wedge 11, 11A, 11B whereas a pin 28 extending from rear wedge 10, 10A, 10B freely crosses a sliding slot 29 arranged in the mobile rear spoiler 4A.

Figure 10:
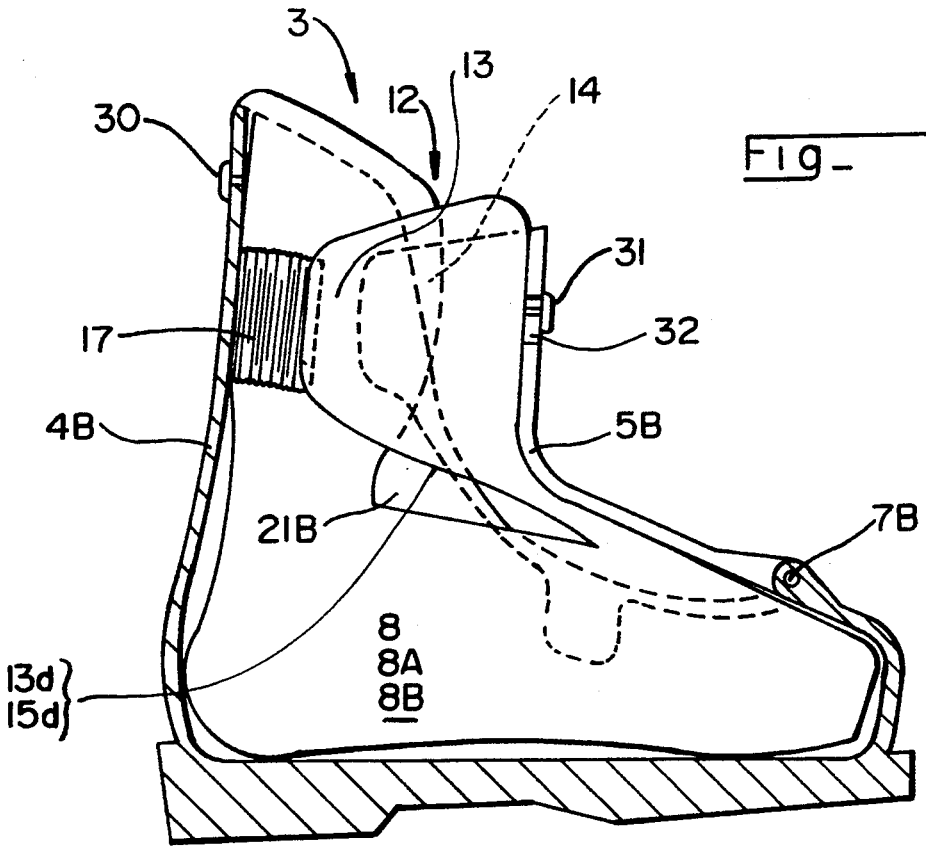
FIGS. 10 and 11 are longitudinal sectional views of a shell of a front entry ski boot equipped with a liner as per the invention, not represented in a section, respectively closed and open.
Figure 11:
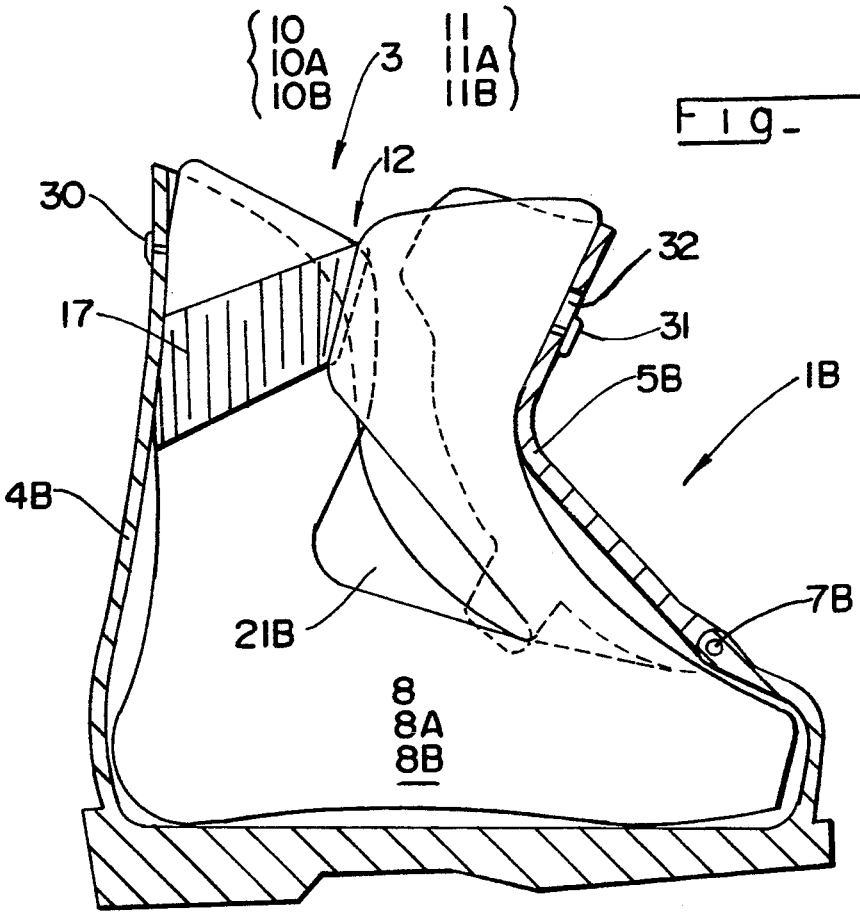

The embodiment of boot 1B represented in FIGS. 10 and 11 mainly differs from the previous embodiments in that its entry occurs from the front, the rear wedge 10, 10A, 10B of liner 8, 8A, 8B is connected fixably to fixed rear spoiler 4B of upper 3, whereas the front wedge 11, 11A, 11B is slidably connected to the corresponding front cuff 5B of upper 3, itself journalled at axis 7b, in a front upper zone of shell base 2.

In this case a rivet 30 ensures the connection of rear spoiler 4B with rear wedge 10, 10A, 10B whereas a pin 32 extending from front wedge 11, 11A, 11B freely crosses a sliding slot 32 arranged in the mobile front cuff 5B.

It must be noted that in the last two examples, related to rear entry 1A and front entry 1B boots, the shape of cutout 21A and 21B is directed in a direction favoring the deformation of the taperings that it defines on the liner.

Also, the return force of elastic connection element 17, 18, 19, 20 of front 11, 11A, 11B and rear 10, 10A, 10B wedges of liner 8, 8A, 8B is such as to simultaneously ensure the return of front cuffs 5, 5A, 5B and/or rear spoilers 4, 4A, 4B of upper 3 on which are connected the wedges of the liner.

It is understood that the implementation of the sliding and/or fixed connections of front wedges 41, 41B and rear wedges 40, 40B of liners 38, 38B with the component portions of upper 3 of the boot is applicable to the latter elements.

The instant application is based upon French patent application 92.10111 of Aug. 14, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a shell base;

an upper extending upwardly from said shell base, said upper comprising a front portion and a rear portion;

means for enabling at least one of said front portion of said upper and said rear portion of said upper to pivot along a generally transverse axis with respect to said shell base between a closed position, whereby said upper substantially surrounds the lower leg of the skier, and a maximum open position of insertion of the foot and lower leg of the skier within said boot;

a liner comprising a pad positioned within shell base and within said upper, said liner comprising a body for enveloping the foot of the skier and, extending upwardly from said body and further comprising a front wedge portion and a rear wedge portion, said front wedge portion being positioned forwardly of the lower leg of the skier when the lower leg is inserted within said boot, said rear wedge portion being positioned rearwardly of the lower leg of the skier when the lower leg is inserted within said boot, said front wedge portion and said rear wedge portion having respective parts spaced apart a predeterminate distance in said closed position of said upper for receiving between said respective parts the lower leg of the skier, said front wedge portion having at least one straddling zone, said rear wedge portion having at least one straddling zone, said straddling zone of said front portion straddling said straddling zone of said rear portion along a predeterminate length in said closed position of said upper to thereby define a mutual straddling zone of said front and rear portions of said upper; and means for maintaining said straddling of said straddling zone of said front portion and said straddling zone of said rear portion in said maximum open position of said upper, said means comprising at least one elastic extensible connection element extending from a portion of said front wedge portion to a portion of said rear wedge portion for exerting an elastic biasing force in a direction to close said liner around the lower leg of the skier.

2. A ski boot according to claim 1, further comprising:

means for affixing said liner to said upper, wherein said means for maintaining said straddling of said straddling zone of said front portion and said straddling zone of said rear portion in said maximum open position of said upper further comprises means for moving said upper of said ski boot to said closed position.

3. An alpine ski boot according to claim 1, wherein:

said respective parts of said front wedge portion and said rear wedge portion are spaced apart a greater predeterminate distance in said open position of said upper;

said predeterminate length of said straddling zones of said front and rear wedge portions is at least equal to a difference between said greater predeterminate distance said respective parts of said front and rear wedge portions are spaced apart in said open position of said upper and said predetermined distance respective parts of said front and rear wedge portions are spaced apart in said closed position of said upper; and said extensible connection element has a maximum extension capacity for maintaining said predetermined length of said straddling zones to be greater than zero for ensuring that said straddling zone of said front portion straddles said straddling zone of said rear portion even during a maximum extension of said extensible connection element.

4. An alpine ski boot according to claim 1, wherein:

said mutual straddling zone of said front and rear wedge portions is located on a lateral side of said liner, said liner further comprising a mutual straddling zone of said front and rear wedge portions located on an opposite lateral side of said liner, said front wedge straddling zones on either lateral side of said liner being located externally of said rear wedge straddling zones.

5. An alpine ski boot according to claim 4, wherein:

said at least one extensible connection element comprises an extensible connection element on either lateral side of said liner, each said extensible connection element extending from an end portion of a respective front wedge portion to a portion of a respective rear wedge portion and being external to each said respective front and rear wedge portions.

6. An alpine ski boot according to claim 1, wherein:

said mutual straddling zone of said front and rear wedge portions is located on a lateral side of said liner, said liner further comprising a mutual straddling zone of said front and rear wedge portions located on an opposite lateral side of said liner, said front wedge straddling zones on either lateral side of said liner being located internally of said rear wedge straddling zones.

7. An alpine ski boot according to claim 1, wherein:

in a connection area between said body of said liner and said front and rear wedge portions of said liner, a cutout is formed for facilitating flexion of said front and rear wedge portions of said liner with respect to said body of said liner.

8. An alpine ski boot according to claim 1, wherein:

said at least one extensible connection element comprises means for biasing at least one of said front portion of said upper and said rear portion of said upper toward said closed position.

9. An alpine ski boot according to claim 1, wherein:

said at least one extensible connection element comprises means for causing said upper to be positioned in said closed position.

10. An alpine ski boot comprising:

a shell base;

an upper extending upwardly from said shell base, said upper comprising a front portion and a rear portion;

means for enabling at least one of said front portion of said upper and said rear portion of said upper to pivot along a generally transverse axis with respect to said shell base between a closed position, whereby said upper substantially surrounds the lower leg of the skier, and an open position for permitting the foot and lower leg of the skier to be inserted within said boot, said means comprising at least one transverse pivot pin at a junction of said shell base and said upper;

a unitary liner comprising a pad positioned within shell base and within said upper, said liner being unitarily removable from within said shell base and from within said upper, said liner comprising a body for enveloping the foot of the skier and, extending upwardly from said body and further comprising a front wedge portion and a rear wedge portion, said front wedge portion being positioned forwardly of the lower leg of the skier when the lower leg is inserted within said boot, said rear wedge portion being positioned rearwardly of the lower leg of the skier when the lower leg is inserted within said boot, said front wedge portion and said rear wedge portion having respective parts spaced apart a predeterminate distance in said closed position of said upper for receiving between said respective parts the lower leg of the skier, said front wedge portion having at least one straddling zone, said rear wedge portion having at least one straddling zone, said straddling zone of said front portion straddling said straddling zone of said rear portion along a predeterminate length in said closed position of said upper to thereby define a mutual straddling zone of said front and rear portions of said upper;

at least one extensible connection element extending from a portion of said front wedge portion to a portion of said rear wedge portion for exerting an elastic biasing force in a direction toward said closed position of said upper; and said mutual straddling zone of said front and rear wedge portions consisting of only a single mutual straddling zone, said front and rear wedge portions thereby constituting a single liner portion extending around and closing on the lower leg unilaterally.

11. An alpine ski boot according to claim 10, wherein:

said at least one extensible connection element consists of only a single extensible connection element extending between said front and rear wedge portions across at least a portion of said single mutual straddling zone.

12. An alpine ski boot comprising:

a shell base;

an upper extending upwardly from said shell base, said upper comprising a front portion and a rear portion;

means for enabling at least one of said front portion of said upper and said rear portion of said upper to pivot along a generally transverse axis with respect to said shell base between a closed position, whereby said upper substantially surrounds the lower leg of the skier, and an open position for permitting the foot and lower leg of the skier to be inserted within said boot, said means comprising at least one transverse pivot pin at a junction of said shell base and said upper;

a unitary liner comprising a pad positioned within shell base and within said upper, said liner being unitarily removable from within said shell base and from within said upper, said liner comprising a body for enveloping the foot of the skier and, extending upwardly from said body and further comprising a front wedge portion and a rear wedge portion, said front wedge portion being positioned forwardly of the lower leg of the skier when the lower leg is inserted within said boot, said rear wedge portion being positioned rearwardly of the lower leg of the skier when the lower leg is inserted within said boot, said front wedge portion and said rear wedge portion having respective parts spaced apart a predeterminate distance in said closed position of said upper for receiving between said respective parts the lower leg of the skier, said front wedge portion having at least one straddling zone, said rear wedge portion having at least one straddling zone, said straddling zone of said front portion straddling said straddling zone of said rear portion along a predeterminate length in said closed position of said upper to thereby define a mutual straddling zone of said front and rear portions of said upper;

at least one extensible connection element extending from a portion of said front wedge portion to a portion of said rear wedge portion for exerting an elastic biasing force in a direction toward said closed position of said upper;

said mutual straddling zone of said front and rear wedge portions being located on a lateral side of said liner, said liner further comprising a mutual straddling zone of said front and rear wedge portions located on an opposite lateral side of said liner, said front wedge straddling zones on either lateral side of said liner being located internally of said rear wedge straddling zones; and said at least one extensible connection element comprising an extensible connection element extending from a fixed attachment area on an external surface of said rear wedge portion and externally surrounding said front wedge portion.

13. An alpine ski boot comprising:

a shell base;

an upper extending upwardly from said shell base, said upper comprising a front portion and a rear portion;

means for enabling at least one of said front portion of said upper and said rear portion of said upper to pivot along a generally transverse axis with respect to said shell base between a closed position, whereby said upper substantially surrounds the lower leg of the skier, and an open position for permitting the foot and lower leg of the skier to be inserted within said boot, said means comprising at least one transverse pivot pin at a junction of said shell base and said upper;

a unitary liner comprising a pad positioned within shell base and within said upper, said liner being unitarily removable from within said shell base and from within said upper, said liner comprising a body for enveloping the foot of the skier and, extending upwardly from said body and further comprising a front wedge portion and a rear wedge portion, said front wedge portion being positioned forwardly of the lower leg of the skier when the lower leg is inserted within said boot, said rear wedge portion being positioned rearwardly of the lower leg of the skier when the lower leg is inserted within said boot, said front wedge portion and said rear wedge portion having respective parts spaced apart a predeterminate distance in said closed position of said upper for receiving between said respective parts the lower leg of the skier, said front wedge portion having at least one straddling zone, said rear wedge portion having at least one straddling zone, said straddling zone of said front portion straddling said straddling zone of said rear portion along a predeterminate length in said closed position of said upper to thereby define a mutual straddling zone of said front and rear portions of said upper;

at least one extensible connection element extending from a portion of said front wedge portion to a portion of said rear wedge portion for exerting an elastic biasing force in a direction toward said closed position of said upper; and means for guiding at least one of said front wedge portion of said liner and said rear wedge portion of said liner in a sliding relationship with respect to a respective one of said front portion of said upper and said rear portion of said upper.

14. An alpine ski boot according to claim 13, wherein:

said means for enabling at least one of said front portion of said upper and said rear portion of said upper to pivot comprises means for enabling at least said front portion of said upper to pivot with respect to said shell base; and said means for guiding at least one of said front wedge portion of said liner and said rear portion of said liner in a sliding relationship comprises means for guiding at least said front wedge portion of said liner in a sliding relationship with respect to said front portion of said upper.

15. An alpine ski boot according to claim 13, wherein:

said means for enabling at least one of said front portion of said upper and said rear portion of said upper to pivot comprises means for enabling at least said rear portion of said upper to pivot with respect to said shell base; and said means for guiding at least one of said front wedge portion of said liner and said rear portion of said liner in a sliding relationship comprises means for guiding at least said rear wedge portion of said liner in a sliding relationship with respect to said rear portion of said upper.

16. An alpine ski boot according to claim 13, wherein:

said means for enabling at least one of said front portion of said upper and said rear portion of said upper to pivot comprises means for enabling said front portion of said upper to pivot with respect to said shell base and means for enabling said rear portion of said upper to pivot with respect to said shell base; and said means for guiding at least one of said front wedge portion of said liner and said rear portion of said liner in a sliding relationship comprises means for guiding said front wedge portion of said liner in a sliding relationship with respect to said front portion of said upper and means for guiding said rear wedge portion of said liner in a sliding relationship with respect to said rear portion of said upper.

* * * * *